US007695244B2

(12) United States Patent
Au

(10) Patent No.: US 7,695,244 B2
(45) Date of Patent: Apr. 13, 2010

(54) VANE FOR A GAS TURBINE ENGINE

(75) Inventor: Andy C-Y Au, Derby (GB)

(73) Assignee: Rolls-Royce PLC, London (GB)

( * ) Notice: Subject to any disclaimer, the term of this patent is extended or adjusted under 35 U.S.C. 154(b) by 868 days.

(21) Appl. No.: 11/303,958

(22) Filed: Dec. 19, 2005

(65) Prior Publication Data

US 2006/0222487 A1 Oct. 5, 2006

(30) Foreign Application Priority Data

Jan. 28, 2005 (GB) ..... 0501757.9

(51) Int. Cl.
*F01D 11/00* (2006.01)

(52) U.S. Cl. ..... 415/174.4; 415/174.5

(58) Field of Classification Search ..... 415/173.6, 415/173.7, 209.2, 209.3, 174.4, 174.5, 231
See application file for complete search history.

(56) References Cited

U.S. PATENT DOCUMENTS

| | | | | |
|---|---|---|---|---|
| 3,081,097 | A | 3/1963 | Dison et al. | |
| 3,494,709 | A * | 2/1970 | Piearcey | 416/232 |
| 3,551,068 | A * | 12/1970 | Allen et al. | 415/173.7 |
| 3,941,500 | A * | 3/1976 | Glenn | 415/136 |
| 4,113,406 | A | 9/1978 | Lee et al. | |
| 4,295,785 | A | 10/1981 | Lardellier | |
| 5,462,403 | A * | 10/1995 | Pannone | 415/173.1 |
| 5,584,654 | A * | 12/1996 | Schaefer et al. | 415/209.3 |
| 5,833,244 | A | 11/1998 | Salt et al. | |
| 6,352,264 | B1 * | 3/2002 | Dalzell et al. | 415/173.6 |
| 6,722,850 | B2 * | 4/2004 | Burdgick | 415/230 |
| 2004/0150164 | A1 * | 8/2004 | Morgan | 277/345 |

FOREIGN PATENT DOCUMENTS

| | | | |
|---|---|---|---|
| EP | 0 953 730 | A3 | 11/1999 |
| EP | 1 167 695 | A1 | 1/2002 |
| EP | 1369562 | A2 * | 12/2003 |
| EP | 1 420 145 | A2 | 5/2004 |
| GB | 629770 | | 9/1949 |
| GB | 780137 | | 7/1957 |

* cited by examiner

*Primary Examiner*—Christopher Verdier
(74) *Attorney, Agent, or Firm*—Oliff & Berridge, PLC

(57) ABSTRACT

A vane for a gas turbine engine includes an aerofoil part and a shroud that forms a sealing part at one end of the aerofoil part. The sealing part defines a cavity and an opening to the cavity. The sealing part may include a pair of opposed side walls extending from a radially outer wall of the shroud to a pair of radially inner walls of the shroud to define a cavity. The pair of radially inner walls may be substantially parallel to the radially outer wall and may extend in a substantially circumferential direction to define a cavity opening.

16 Claims, 1 Drawing Sheet

VANE FOR A GAS TURBINE ENGINE

The present invention concerns vanes for gas turbine engines.

Conventionally, an axial flow compressor of a gas turbine engine is a multi stage unit, each stage comprising a row of rotor blades followed by a row of stator vanes. During operation, the rotor blades are turned at high speed so that air is continuously induced into the compressor. The air is accelerated by the rotor blades and swept rearwards onto the adjacent row of stator vanes. The pressure of the air is increased by the energy imparted to the air by the rotor blades, which increase the air velocity. The air is then decelerated in the following row of stator vanes, resulting in a further increase in the pressure of the air. There is thus a continuous increase in air pressure as the air moves through the multiple rows of rotor blades and stator vanes.

FIG. 1 shows an example of part of a known vane 10. The vane 10 comprises an aerofoil part 12 and a sealing part in the form of a shroud 14, the shroud 14 being at one end of the aerofoil part 12. The shroud 14 is in the form of a closed box section comprising an outer wall 16, an opposed inner wall 20, and four side walls 18 extending between the outer wall 16 and the inner wall 20, the outer wall 16, the inner wall 20 and the side walls 18 together defining an enclosed cavity 22. The terms "outer" and "inner" are used relative to the axis of rotation of the rotor blades, which is the longitudinal axis of the engine. The inner wall 20 includes an external face 21 which forms an end face of the vane 10. The end face 21 is provided with a layer of abradable material 24.

The vane 10 includes a mounting part (not shown) which is mounted to a compressor casing (not shown) so that the vane extends inwardly from the compressor casing to a rotor drum surface 26. The rotor drum surface 26 includes a plurality of sealing fins 28 which project from the rotor drum surface 26 and contact the abradable material 24.

In operation, air moves from left to right across the stator vane aerofoil part 12 as shown in FIG. 1 by arrow A, and the pressure of the air increases so that the pressure on the right hand side of the aerofoil 12 is greater than on the left hand side. The pressure differential causes air to attempt to leak back through a space 32 defined between the layer of abradable material 24 on the end face 21 and the rotor drum surface 26 as shown by arrow B. Such leakage reduces the efficiency of the engine, and is substantially prevented by the contact of the sealing fins 28 with the abradable surface 24, so that the efficiency of the compressor part of the engine is not impaired.

However there are a number of disadvantages with this arrangement. The preferred method of manufacture of the stator vanes is to cast the vane with the shroud as a single item, but the closed box section of the shroud 14 is difficult to cast as the casting material tends not to flow properly around the shroud and into the aerofoil part. To overcome this problem, vanes are cast in two parts and the two parts welded together. However, this solution entails extra steps in the manufacturing process and hence such vanes are relatively more expensive to produce. Contact between the sealing fins 28 and the abradable material 24 can be lost due to wear, and when this happens leakage points can form. At such leakage points localised airflows can "punch" through adjacent sealing fins, rapidly leading to the formation of leakage points in adjacent sealing fins.

According to the present invention, there is provided a vane for a gas turbine engine, the vane including an aerofoil part and a sealing part at one end of the aerofoil part, the sealing part defining a cavity and an opening to the cavity.

Preferably, the sealing part includes an end face which may form an end face of the vane, and the cavity opening may be defined in the end face. Preferably, the cavity opening is in the form of a slot, and preferably the slot extends across the end face, so that the end face is divided by the slot into two parts. Preferably, the cavity is enlarged relative to the cavity opening. Preferably, the width of the cavity is wider than the width of the cavity opening. Preferably the cavity extends through the sealing part.

Preferably, the end face is provided with a layer of abradable material.

Preferably the vane includes a mounting part, which may be located at an opposite end of the aerofoil part.

Preferably the vane is a stator vane or a nozzle guide vane, and may be locatable in a compressor part or a turbine part of a gas turbine engine.

Preferably the vane is formed by casting and may be formed of metal.

Further according to the present invention, there is provided a gas turbine engine, the engine including a plurality of vanes, each vane being as described above.

Preferably the vanes are arranged so that the cavity of one vane communicates with the cavity of an adjacent vane. Preferably the vanes are arranged so that the adjacent cavities form a passage, which may be continuous.

Preferably, the engine includes sealing means, to seal spaces defined between the sealing part of the vanes and an adjacent part of the engine. Preferably, the sealing means include a plurality of sealing fins. Preferably, the sealing fins contact the end faces of the vanes.

Preferably, the volume of each cavity is relatively large compared to the volume of each respective space.

The invention further provides an aircraft, the aircraft including an engine as set out above.

The present invention will now be described, by way of example only, and with reference to the accompanying drawings, in which:—

Figure 2:
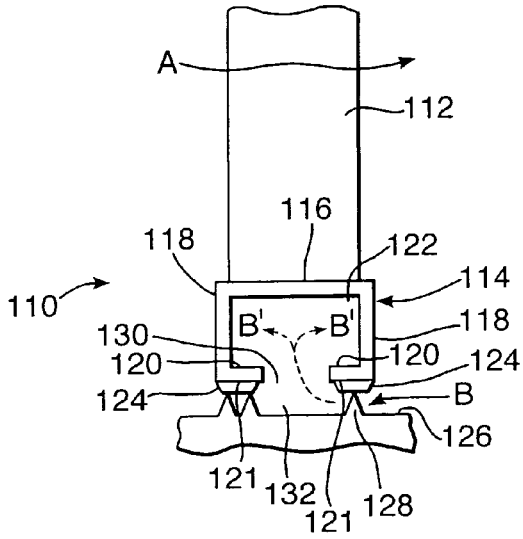
FIG. 2 is a sectional side view of part of a gas turbine engine according to the invention.

FIG. 2 shows part of a vane 110 according to the invention. The vane 110 includes an aerofoil part 112 and a sealing part in the form of a shroud 114, which is located at the radially inner end of the aerofoil part 112. The shroud 114 comprises an outer wall 116, an inner wall 120 and a pair of opposed side walls 118 extending between the outer wall 116 and the inner wall 120. The outer wall 116, the inner wall 120 and the side walls 118 together define a cavity 122. The inner wall 120 defines a cavity opening 130 in the form of a slot which extends across the inner wall 120, so that the inner wall 120 is divided by the slot 130 into two parts.

The width of the cavity 122 is wider than the width of the slot 130. The cavity 122 extends through the shroud 114. The inner wall 120 includes a face 121 which forms a radially inner end face of the vane 110. The end face 121 is provided with a layer of abradable material 124.

The vane 110 includes a mounting part (not shown in FIG. 2) which in use is mounted to a compressor casing (not shown in FIG. 2) so that the vane 110 extends inwardly from the compressor casing towards a rotor drum surface 126. The rotor drum surface 126 includes a plurality of sealing fins 128 which project from the rotor drum surface 126 and contact the abradable material 124.

A space 132 is defined between the layer of abradable material 124 on the end face 121 and the rotor drum surface 126. The volume of the cavity 122 is relatively large in comparison with the volume of the space 132.

In one particular example, the width of the slot 130 is between 5 to 10 mm, the width depending on the size of the vane and the position of the vane in the engine.

In operation, air flows from left to right across the aerofoil part 112 of the vane 110 as indicated by arrow A in FIG. 2, and there is a pressure differential across the aerofoil part 112 as described previously for the vane shown in FIG. 1. The pressure differential results in a leakage air flow as indicated by arrow B, which is prevented by the engagement of the sealing fins 128 against the abradable material 124. Should localised leakage occur, the air flow as indicated by arrow B will leak into the relatively large volume provided by the cavity 122 end the slot 130 as indicated by dotted arrows B' in FIG. 2. This helps prevent the formation of localised airflows which could punch through adjacent sealing fins, by diffusion of the airflow into the larger volume.

It will be noted in FIG. 2 that the location of the sealing fins 128 is arranged to correspond with the location of the abradable material 124 on the end face 121.

Figure 3:
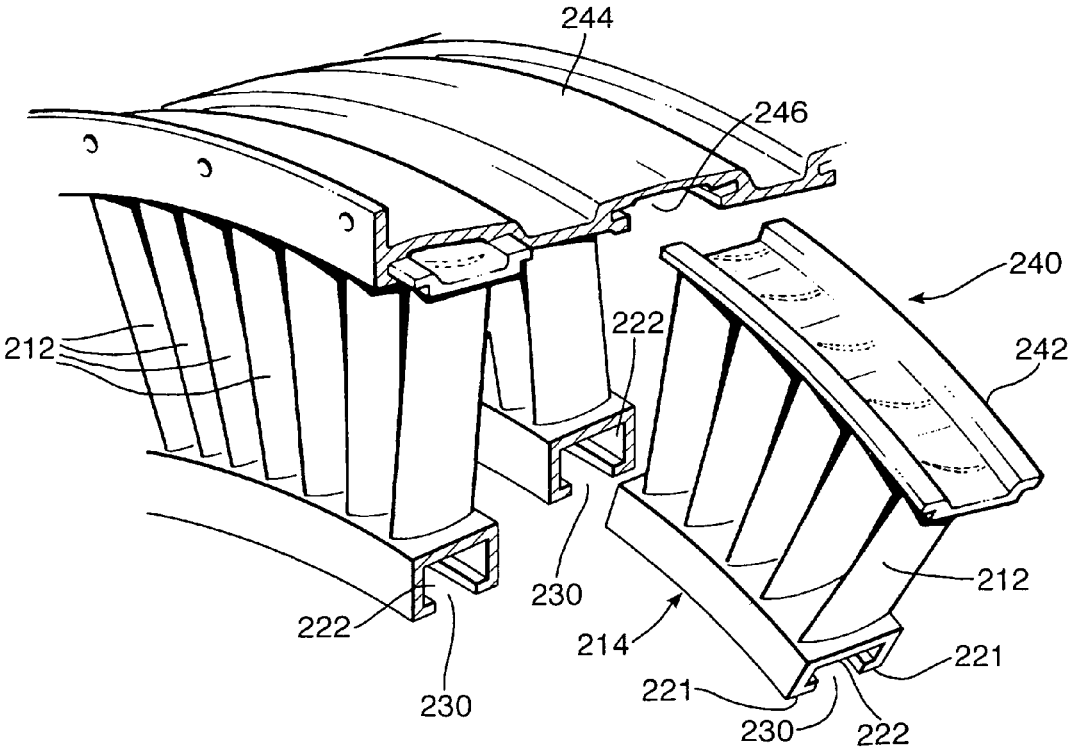
FIG. 3 is a perspective view of part of a gas turbine engine according to the invention in a partly disassembled condition.

FIG. 3 shows a part of a gas turbine engine according to the invention in a partly disassembled condition. It is known to provide vane segments which effectively comprise a plurality of vanes. In the example shown in FIG. 3, a vane segment 240 comprises a plurality of aerofoil parts 212. At one end of the aerofoil parts 212 the vane segment includes a mounting part 242, and at the other end of the aerofoil parts 212 the vane segment 240 includes a sealing part 214 in the form of a shroud. The shroud 214 is of similar form to that described above for the embodiment shown in FIG. 2. The shroud 214 defines a cavity 222 and a cavity opening in the form of a slot 230 located in an end face 221 of the segment 240. The cavity 222 is wider than the width of the slot 230. The cavity 222 and the slot 230 extend through and along the length of the shroud 214. The shroud 214 is curved along its length.

The vane segment 240 is mounted to a compressor casing 244. The mounting part 242 slidably locates in a channel 246 defined in the compressor casing 244 in a known manner. A plurality of vane segments 240 are mounted to the compressor casing 244 to form a continuous ring. In the assembled condition, the shroud 214 of one vane segment 240 abuts the shroud 214 of an adjacent vane segment 240 so that the cavity 222 and the slot 230 of the one vane segment 240 communicate with the cavity 222 and the slot 230 of the adjacent vane segment 240 respectively. Thus a continuous annular passage is formed by the cavities 222 and the slots 230 of the assembled vane segments 240. As for the embodiments shown in FIGS. 1 and 2, in the assembled condition the end faces 221 are each provided with a layer of abradable material (not shown) which contacts sealing fins (not shown) projecting from a rotor drum surface (not shown).

In operation, any leakage of air flow past the sealing fins is diffused along the passage formed by the cavities 222 and the slots 230. If leakage continues, it may be expected that the pressure in the cavities 222 and the slots 230 will rise to equal that of the higher pressure side of the aerofoil parts 212. In this condition, the higher pressure air in the cavities 222, the slots 230 and the space between the slots 222 and the rotor drum surface (not shown in FIG. 3) forms a buffer against the effects of localised air flow through the leakage points in the sealing fins.

Figure 1:
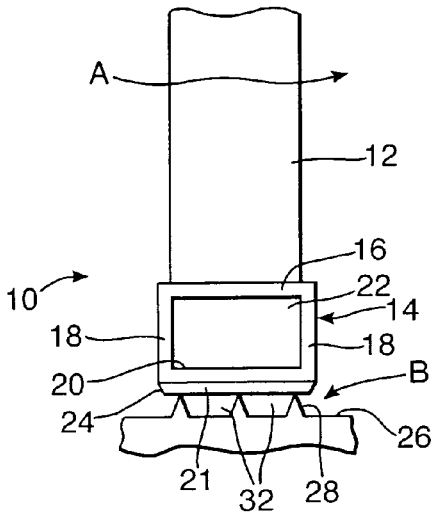
Fig.1. PRIOR ART
FIG. 1 is a sectional side view of part of a known gas turbine engine.

Vanes and vane segments according to the invention can be cast in one piece relatively easily and therefore more cheaply in comparison with the vanes with the closed box section shrouds shown in FIG. 1. Vanes and vane segments according to the invention contain less material and are also lighter, and therefore cheaper to manufacture than the known vanes shown in FIG. 1.

Various modifications may be made within the scope of the invention. In particular, similar components according to the invention could be utilised in a turbine part of the engine. The cavity could be of any convenient size or shape. The vane could be formed of any suitable material, and by any suitable process. The cavity opening could be of any suitable size, and could be located in any suitable position in the end face of the vane. For example, a slot could be provided which was offset from the central axis of the shroud.

There is thus provided a vane for a gas turbine engine which is easier, and therefore likely to be cheaper, to manufacture, and provides improved sealing so that the efficiency of the engine is maintained during operation.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A vane for a gas turbine engine comprising:

an aerofoil part extending in a substantially radial direction; and a shroud disposed at a radially inner end of the aerofoil part to form a sealing part, the shroud comprising a pair of opposed side walls extending from a radially outer wall of the shroud to a pair of radially inner walls of the shroud to define a cavity, the pair of radially inner walls being substantially parallel to the radially outer wall and extending in a substantially circumferential direction to define a cavity opening having a width which is narrower than a width of the cavity, the pair of radially inner walls each having a radially inner face being provided with a layer of abradable material, the inner face of each of the inner walls being an outside surface of the inner wall opposite and substantially parallel to the radially outer wall.

2. The vane of claim 1, further comprising a mounting part.

3. The vane of claim 2, wherein the mounting part is disposed at an end of the aerofoil opposite the sealing part.

4. The vane of claim 1, wherein the vane is one of a stator vane and a nozzle guide vane.

5. The vane of claim 4, wherein the vane is configurable to be disposed in a compressor part or a turbine part of the gas turbine engine.

6. The vane of claim 1, wherein the vane is formed by casting.

7. The vane of claim 1, wherein the vane is formed of metal.

8. A gas turbine engine comprising a plurality of vanes including the vane of claim 1.

9. The engine of claim 8, wherein the vanes are arranged such that the cavity of the vane communicates with a cavity of an adjacent vane.

10. The engine of claim 9, wherein the vanes are arranged such that adjacent cavities form a passage.

11. The engine of claim 10, wherein the passage is continuous.

12. The engine of claim 8, further comprising a sealing means configured to seal spaces defined between the sealing part of the vanes and an adjacent part of the engine.

13. The engine of claim 12, wherein the sealing means comprises a plurality of sealing fins.

14. The engine of claim 13, wherein the sealing fins contact end faces of the vanes.

15. The engine of claim 12, wherein a volume of the cavity is relatively large compared to a volume of each of the spaces.

16. An aircraft comprising the engine of claim 8.

* * * * *